United States Patent [19]

Huber et al.

[11] Patent Number: 4,500,325

[45] Date of Patent: Feb. 19, 1985

[54] ABRASIVE ARTICLE

[75] Inventors: Johann Huber, Kramsach; Otto Thanner, Schwaz, both of Austria

[73] Assignee: Tyrolit Schleifmittelworke Swarovski K.G., Austria

[21] Appl. No.: 398,595

[22] Filed: Jul. 15, 1982

[30] Foreign Application Priority Data

Jul. 20, 1981 [AT] Austria ..... 3189/81

[51] Int. Cl.[3] ..... B24D 3/34

[52] U.S. Cl. ..... 51/298; 51/307

[58] Field of Search ..... 51/298, 307

[56] References Cited

U.S. PATENT DOCUMENTS

| | | | |
|---|---|---|---|
| 3,592,618 | 7/1971 | Alden et al. | 51/298 |
| 4,263,016 | 4/1981 | Hirschberg | 51/298 |
| 4,381,188 | 4/1983 | Waizer et al. | 51/298 |

FOREIGN PATENT DOCUMENTS

| | | | |
|---|---|---|---|
| 3112954 | 12/1981 | Fed. Rep. of Germany | 51/298 |
| 48-23954 | 7/1973 | Japan | 51/298 |

*Primary Examiner*—James Derrington

*Attorney, Agent, or Firm*—McGlew and Tuttle

[57] ABSTRACT

An abrasive article comprises abrasive grain, a binder material and active fillers. The active fillers are metal halogenides or metallic complex salts.

1 Claim, No Drawings

ABRASIVE ARTICLE

BACKGROUND OF THE INVENTION

1. Field of the Invention

The invention relates to an abrasive article comprising abrasive grain, e.g. corundum, a binder agent such as a binder material, e.g. phenolic resin, or a sintered magnesite bond and active fillers or fillers.

2. Description of the Prior Art

As already mentioned, abrasive disks, e.g. used for severing, comprise three essential components, i.e. the abrasive grain, a binder material or agent for holding the abrasive grain and active fillers.

The present invention relates to the problem of active fillers.

In the grinding operation, such active fillers effect chemical and physical processes which have a positive influence on the behaviour of the abrasive. Such fillers should in particular cause an increase in the service life of the abrasive tool and a decrease heating of the workpiece and the abrasive article and, hence, avoid thermal destruction. In some materials which are hard to cut, e.g. unalloyed, low carbon steels or titanium, such fillers are the prerequisite for economic processing.

Their effects are commonly categorized into the following three major groups:

1. Decrease in the friction between abrasive grain, workpiece and chips, i.e. the fillers and their by-products must have the effect of high temperature lubricants or high pressure lubricants. They can thereby form a primary lubricating film of melted mass (e.g. cryolite) or a solid lubricating film (graphite, molybdenum sulfide, lead oxide). Secondary films may also be formed: metallic chloride (-sulfide) as a filter→chlorine-(sulfur-) -separation→metallic chloride (-sulfide) of the ground material.

2. Protective effect by forming primary or secondary surface films on the abrasive grain, workpiece and chips (analogous to item 1). Grain destruction due to diffusion processes (e.g. spinel formation when grinding iron material containing corundum), welding of the grit to the grain or to the workpiece are thereby avoided.

3. Cooling effects in the microrange due to high melting-, vaporization- and phase change temperatures and thermal phase change points favourable in respect of temperature.

Numerous substances can, however, not or only under certain circumstances be employed in practice as they are expensive (noble metal halegonides, molybdenum sulfide), toxic (arsenic-, selenium-, lead compound), reduce the disk stability (e.g. graphite, sulfur), are of hygroscopic or high water solubility (numerous chlorides) and strongly react with the uncured phenolic resin system (hygroscopic chlorides).

Summing up, it may be said that an optimal active filler must have favourable phase change temperatures and chemically reactive separation products. The filler and its by-products should have a toxicity as low as possible and, hence, high threshold limit values, it should further be inexpensive and its being processed in abrasive articles should be commercially possible, i.e. not only under laboratory conditions.

Particularly the manufacture of disks using resol as the binder material has the disadvantage that the binder material binds prematurely.

SUMMARY OF THE INVENTION

It is the object of the invention to provide abrasive articles with active fillers in which good processing properties of the grinding material with good abrasive properties and low toxidity are combined.

According to the invention this is achieved by providing at least parts of the active fillers in the form of metal halegonides and/or metallic complex salts having the following structure:

$$A_xMe_y^{II}Me_z^{III}Hal_E.nB_fC_gHal_e.mH_2O.oNH_3,$$

wherein A is an alkali metal ion or ammonium ion, x a number between 0 and 10, $Me^{II}$ a bivalent metal ion, i.e. Mn, Ca, Mg, Zn, Sn, Cu, Co, Ni, y a number between 0 and 2, $Me^{III}$ a trivalent metal ion, i.e. Al, B, Ti, z a number between 0 and 2, Hal represents a halogen, E is a number between 1 and 10; n is a number between 0 and 10, B an alkali metal ion or ammonium, f a number between 0 and 1, C represents bivalent element (e.g. Ca, Mg, Zn, Sn, Mn), g is a number between 0 and 1, e a number between 1 and 2, m a number between 0 and 10 and o a number between 0 and 10.

It is advantageously provided that at least part of the active fillers are manganese halegonides or manganese complex salts.

DESCRIPTION OF THE PREFERRED EMBODIMENTS

An embodiment of the invention provides that the manganese halegonides mangan chlorides have the following formula:

$$MnCl_2.xH_2O;\ MnCl_2.xNH_3,$$

whereby x is a number between 0 and 10.

A further embodiments of the invention provides that the manganese complex salts have the following formulas:

$$K_2MnCl_4.$$

The advantages of the abrasive article according to the invention are that the active fillers used therein (a) have very low hygroscopicity, (b) consequently only minor dehydrohalogenation occurs, (c) have low catalytic hardening tendency with resol, which means good manufacturing stability of the abrasive material, and (d) show advantageous thermal decomposition at grinding temperatures.

The latter-mentioned produces high efficiency and good cutting stability even with difficult material.

Examples for fillers according to the invention are:

Manganese chloride ($MnCl_2.xH_2O$), ($MnCl_2.xNH_3$)

Manganese complex salts $(NH_4)_2MnCl_4.2H_2O$ $(NH_4)_6MnCl_8.2H_2O$, $KMnCl_3$, $K_4MnCl_6$, $K_2MnCl_4$, $K_3Mn_2Cl_7$, $K_2MnCl_4.2KCl$, $KMnCl_3.2H_2O$, $K_2MnCl_4.2H_2O$ Tin complex salts $K_2SnCl_4.(NH_4)_2SnCl_4$.

Further examples for fillers according to the invention:

$K_2MnCl_4$ $K_2MnCl_4.KCl$
$K_2MnCl_4.2KCl$
$K_2MnCl_4.3KCl$
$K_2ZnCl_4$
$K_2ZnCl_4.KCl$
$K_2ZnCl_42KCl$
$K_2ZnCl_4.3KCl$
$Na_2MnCl_4$
$Na_2MnCl_4.KCl$
$Na_2MnCl_4.2KCl$
$Na_2MnCl_4.3KCl$
$Na_2ZnCl_4$
$Na_2ZnCl_4.KCl$
$Na_2ZnCl_4.2KCl$
$Na_2ZnCl_4.3KCl$
$K_2MnCl_3F.2KCl$
$K_2ZnCl_3F.2KCl$
$Na_2MnCl_3F.2KCl$
$Na_2ZnCl_3F.2KCl$.

Example for an abrasive article with the filler according to the invention:

| Indications in percent by volume | | |
|---|---|---|
| Grain | 45% | normal corundum 1000 μm grain size |
| Bond | 35% | resin 25%: resol, Novolak filler 11% |
| Fabric reinforcement | 5% | Glass fiber fabric |
| Pores: | 15% | |
| | 100% | |

Manufacture of the abrasive article according to the invention:

First, the abrasive grain was moistened with resol, then the bond consisting of Novolak and filler was added and thoroughly mixed for 5 minutes. The mixture was allowed to stand for 5 hours and then pressed. The abrasive disks were hardened at 180° C. for 24 hours.

What is claimed is:

1. An abrasive article comprising abrasive grain, a binder agent, and fillers, at least part of the fillers being active fillers and including metal halogenides, the active fillers being chosen from the group consisting of:

$(NH_4)_2MnCl_4.2H_2O$,
$(NH_4)_6MnCl_8.2H_2O$, $KMnCl_3$, $K_4MnCl_6$, $K_2MnCl_4$, $K_3Mn_2Cl_7$, $K_2MnCl_4.2KCl$, $KMnCl_3.2H_2O$, $K_2MnCl_4.2H_2O$,
$K_2SnCl_4.(NH_4)_2SnCl_4$,
$K_2MnCl_4$,
$K_2MnCl_4.KCl$,
$K_2MnCl_4.2KCl$,
$K_2MnCl_4.3KCl$,
$K_2ZnCl_4$,
$K_2ZnCl_4.KCl$,
$K_2ZnCl_42KCl$,
$K_2ZnCl_4.3KCl$,
$Na_2MnCl_4$,
$Na_2MnCl_4.KCl$,
$Na_2MnCl_4.2KCl$,
$Na_2MnCl_4.3KCl$,
$Na_2ZnCl_4$,
$Na_2ZnCl_4.KCl$,
$Na_2ZnCl_4.2KCl$,
$Na_2ZnCl_4.3KCl$,
$K_2MnCl_3F.2KCl$,
$K_2ZnCl_3F.2KCl$,
$Na_2MnCl_3F.2KCl$ and
$Na_2ZnCl_3F.2KCl$.

* * * * *